United States Patent [19]

Lopez

[11] 4,189,862

[45] Feb. 26, 1980

[54] STRING TOP

[76] Inventor: Ana Lopez, 400 W. 43 St., Apt. 11N, New York, N.Y. 10036

[21] Appl. No.: 903,090

[22] Filed: May 5, 1978

[51] Int. Cl.[2] ..... A63H 1/28; A63H 27/12

[52] U.S. Cl. ..... 46/63; 46/62

[58] Field of Search ..... 46/62, 63, 61, 67; 273/113, 123 R

[56] References Cited

U.S. PATENT DOCUMENTS

| | | | |
|---|---|---|---|
| 976,695 | 11/1910 | Rich | 46/63 |
| 1,076,354 | 10/1913 | Daniel | 46/63 |
| 2,117,133 | 5/1938 | Bell | 46/63 |
| 3,004,365 | 10/1961 | Bertucci | 46/63 |
| 3,501,860 | 3/1970 | Bandy | 46/62 |

FOREIGN PATENT DOCUMENTS

| | | | |
|---|---|---|---|
| 612801 | 4/1935 | Fed. Rep. of Germany | 46/63 |
| 447767 | 4/1949 | Italy | 46/62 |

OTHER PUBLICATIONS

"Puzzle Ball", Sidney A. Tarrson Co., Mar. 1965.

*Primary Examiner*—Russell R. Kinsey
*Assistant Examiner*—Mickey Yu
*Attorney, Agent, or Firm*—Richard L. Miller

[57] ABSTRACT

An action toy that includes a circular top which is fastened between two sets of strings, so that when the top is rotated manually, the strings become wound up, whereby when the string ends are then pulled, the strings unwind causing the top to spin, at high speed and then rewind the strings in opposite directions for reciprocal pull of the strings and additional top spinning; the top being made generally of two hollow, hemispherical transparent members secured to opposite sides of a circular disc that is perforated so that candy can pass therethrough into a chamber on either side.

1 Claim, 13 Drawing Figures

STRING TOP

This invention relates generally to spinning top toys.

A principal object of the present invention is to provide a spinning toy top suspended between windable strings, which in addition to produce an interesting motion, also gives a fascinating sight to children by being hollow and transparent so to allow observation therein.

Another object is to provide a string top, inside which a perforated partition separates two compartments so that marbles, inside the top, can transfer between the compartments.

Still another object is to provide a string top in which the marbles are made of candy so that in case the top hollow body accidently is broken open, and the marbles fall out, they can be edible by small children without harm.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 4A:
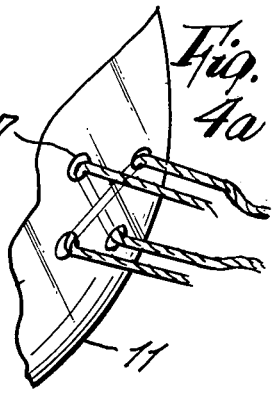

FIG. 4*a* shows one method of string attachment to the dome.

Figure 4B:
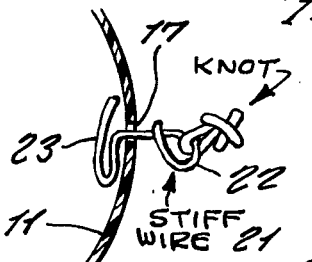
Figure 4C:
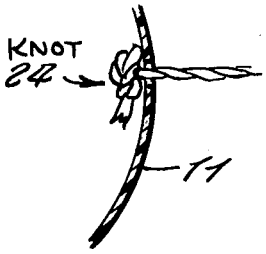

FIGS. 4*b* and 4*c* show other methods of string attachment.

Figure 5:
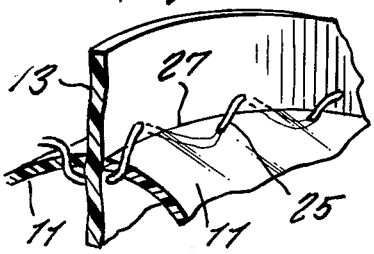

FIG. 5 shows attachment of central disc and both domes together by means of stitching.

Figure 6:
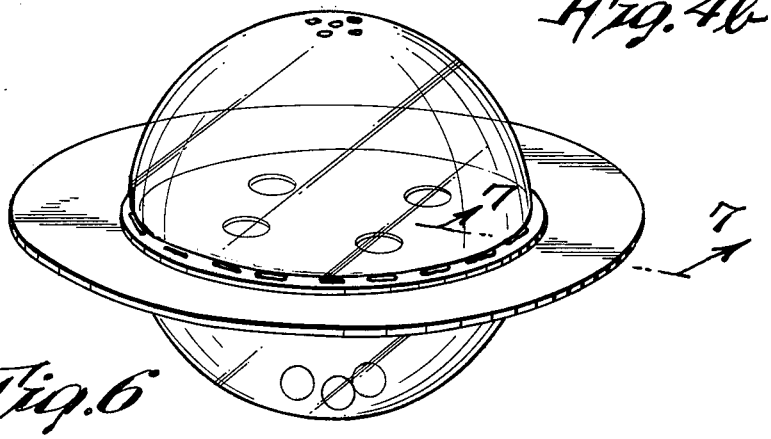

FIG. 6 shows another means of disc and dome attachment wherein each dome is flanged.

Figure 7:
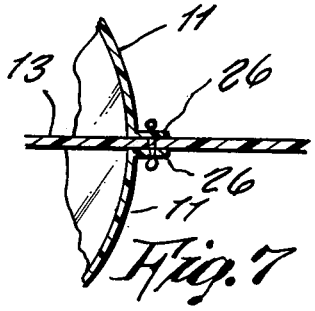

FIG. 7 is a cross section on line 7—7 of FIG. 6.

Figure 8:
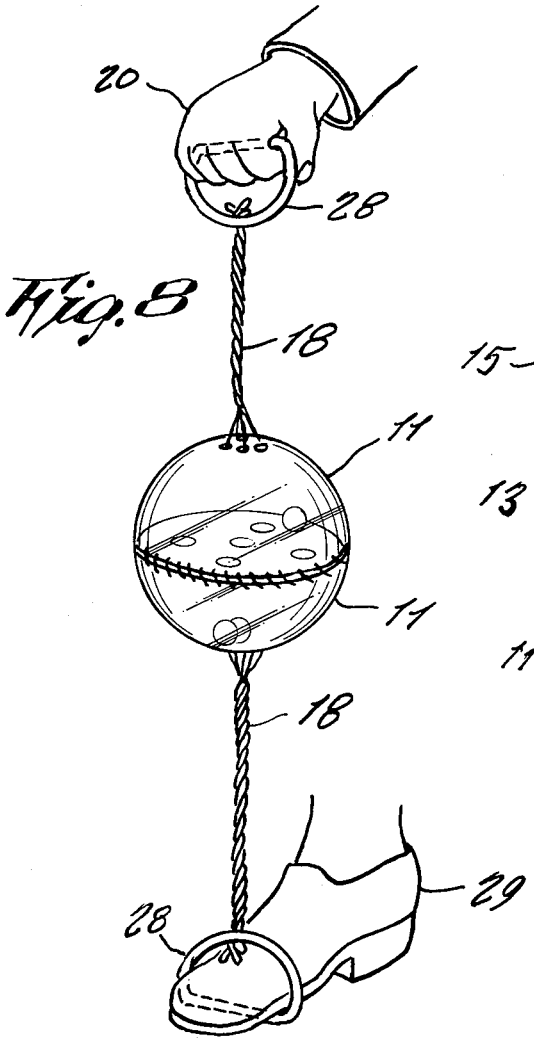

FIG. 8 shows another design of the invention.

Figure 9:
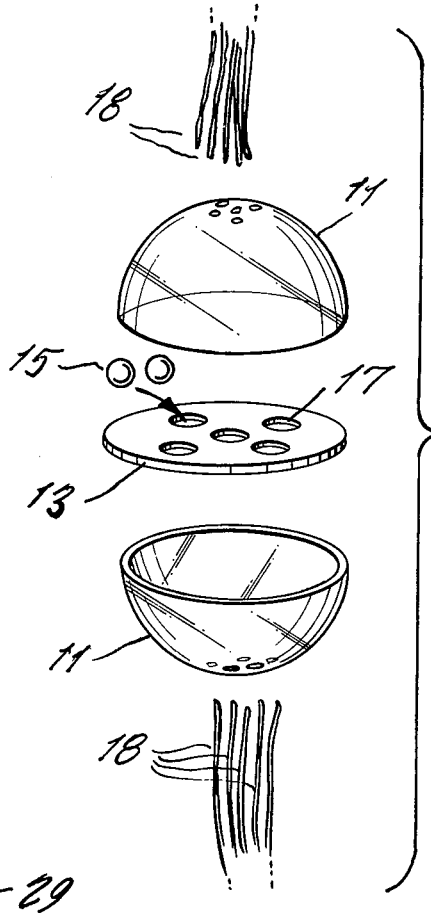

FIG. 9 is an exploded view of the invention components.

Figure 10:
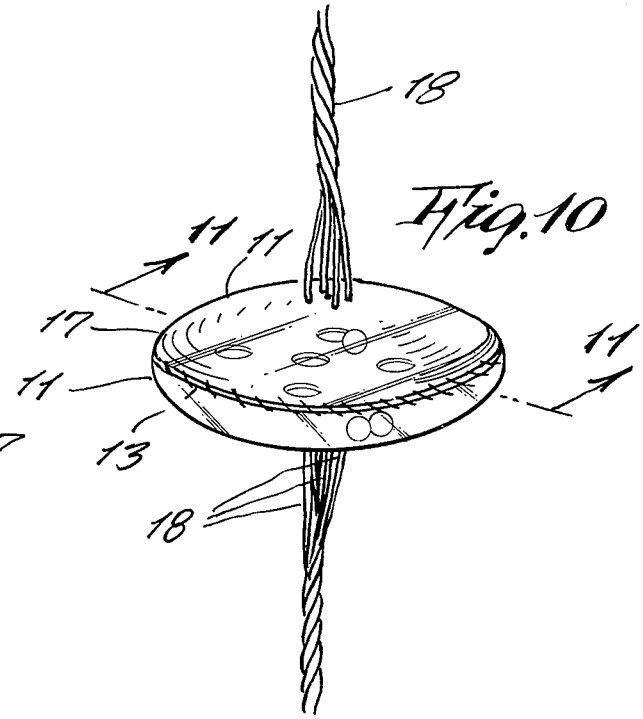

FIG. 10 shows another design of the invention which is more flat, instead spherical.

Figure 11:
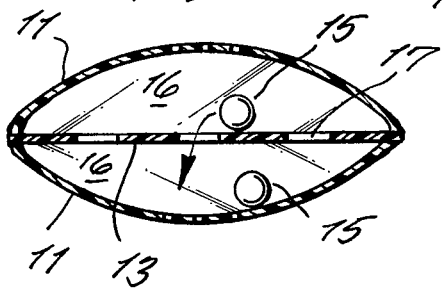

FIG. 11 is a cross section on line 11—11 of FIG. 10.

Figure 1:
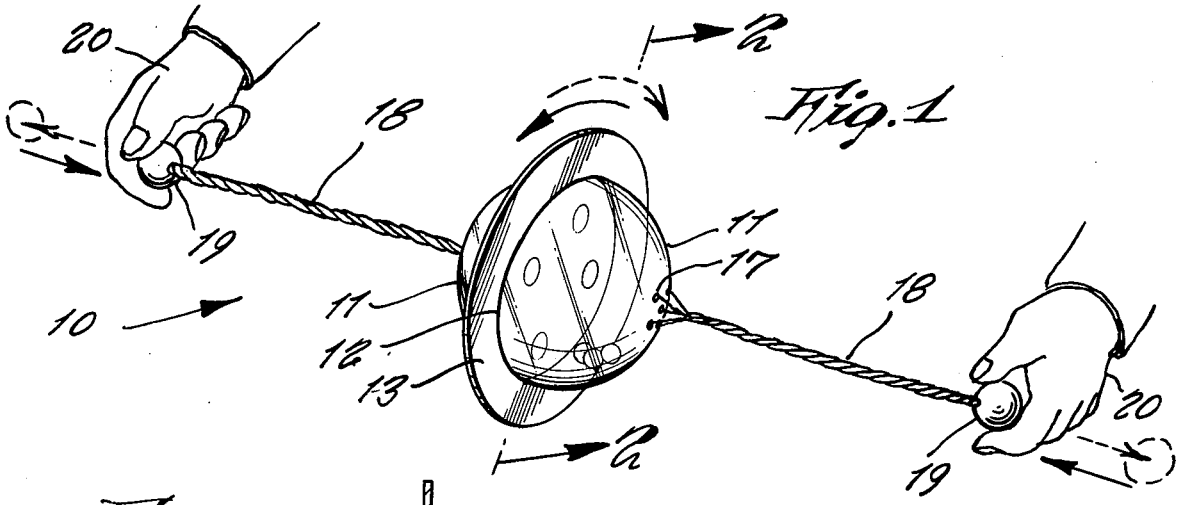
FIG. 1 is a perspective view of four string model with large central disc, shown in use.
Figure 2:
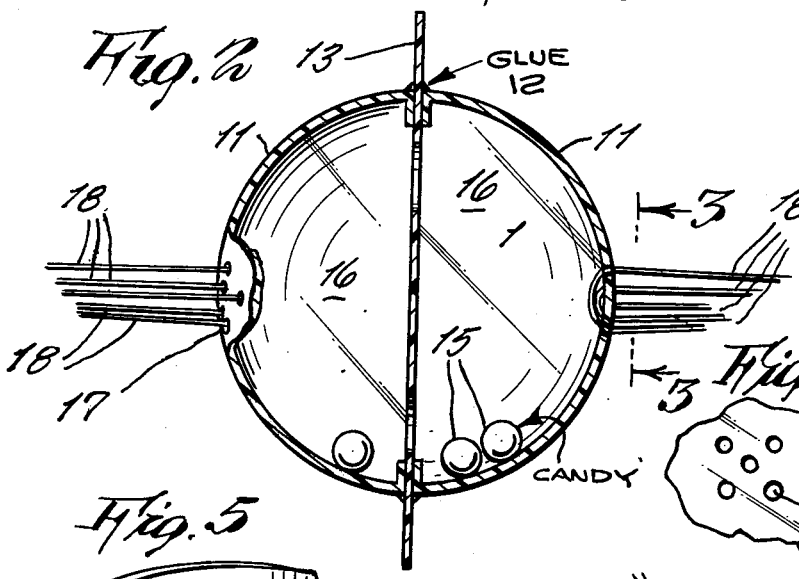
FIG. 2 is a cross section on line 2—2 of FIG. 1.
Figure 3:
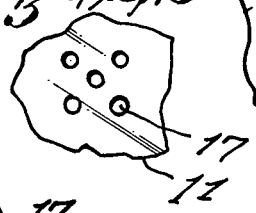
FIG. 3 is a view in direction 3—3 of FIG. 2.

Referring now to the drawings in greater detail, there is shown in FIGS. 1, 2 and 3, one design of string top 10 that includes two hollow, hemispherical domes 11, made of transparent hard plastic, and which are secured by glue 12 to opposite sides of a circular, flat concentric disc 13 located therebetween and which is likewise of a hard plastic. The disc may be of larger diameter than the domes, as shown, and includes several openings 14 therethrough, so that spherical marbles 15, made of a hard candy, can pass therethrough between opposite side compartments 16 thus formed by the disc.

A cluster of five openings 17 through a center of each dome serves for attachment of five strings 18 thereto, so that the above described top member, thus formed, can be suspended therebetween. A knob 19 is secured to the free ends of the five strings extending from each cluster of openings 17.

In operative use, a child grasps each knob with one hand 20, and swings the top member in a circular swing movement so as to wind up the strings. Then he pulls the knobs in a direction away from each other so as to cause the wound up strings to unwind and thus rotate the top member. The rotating momentum of the top member causes the strings to immediately wind up in an opposite direction after the unwind thereof, so that the repeated action can be continued, for amusement of a spinning string top held between the hands.

In FIG. 4*a*, a means of string attachment to the domes consists of simply threading the strings through the openings 17. In FIG. 4*b*, the string attachment consists of each string end being tied to a stiff wire clip 21 bent into a loop 22 at one end, therefor, and bent into a flat ring 23 at its other end for inserting opening 17 and resting against the inner side of the dome. In FIG. 4*c* the string end is simply inserted in the opening 17 and tied into a big knot 24 that is too large to slip through the opening thereafter.

In FIG. 5, another method of attaching the domes and disc together consists of stitched thread 25. FIGS. 6 and 7 show a straight stitch of the thread, instead the round stitch thereof shown in FIG. 5. The dome edges in FIGS. 6 and 7 include a flange 26 so to accomplish this, whereas in FIG. 5, the dome edge 27 simply abutts the side of the disc.

In FIG. 8, a design of string top is shown which includes looped knobs 28, instead knobs 19, at the string free ends, so that a hand 20 and foot 29 can hold the same while the toy is thus operated therebetween in a vertical or other position.

FIGS. 8 and 9 indicate that the disc can be a same diameter and the domes, instead of the design indicated above.

FIGS. 10 and 11 indicate that the domes may be flattened (or else axially extended) instead being hemispherical. The disc may be of any size as above described and may be attached in any manner as stated.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A string top, comprising in combination, a globe held between two sets of strings, said globe being comprised of two, hollow, transparent, hemi-spherical domes with a flat circular disc therebetween, a plurality of holes through said disc and a plurality of marbles inside said globe so as to freely roll through said holes between said domes; a plurality of openings on diametrically opposite side of said globe, each said set of strings comprising a plurality of individual strings each one of which is directly attached in one of said openings, said openings at each said side of said globe being a distance apart that is greater than a diameter of a stranded cord formed by said strings when rolled up together.

* * * * *